US005826632A

United States Patent [19]

Mické et al.

[11] Patent Number: 5,826,632

[45] Date of Patent: Oct. 27, 1998

[54] DYNAMIC GAS CYLINDER FILLING PROCESS

[75] Inventors: André Mické, Summit, N.J.; Lesli B. Cosey, West Chicago, Ill.

[73] Assignee: The BOC Group, Inc., New Providence, N.J.

[21] Appl. No.: 866,753

[22] Filed: May 30, 1997

[51] Int. Cl.[6] ..... B65B 1/04; B65B 3/04

[52] U.S. Cl. ..... 141/9; 141/83; 141/94; 141/105; 137/3; 137/93

[58] Field of Search ..... 141/94, 9, 83, 141/47, 49, 54, 99, 192, 105; 137/3, 4, 88, 92, 93; 222/145.5, 145.6; 73/23.21, 23.24

[56] References Cited

U.S. PATENT DOCUMENTS 3,948,281 4/1976 Strain et al. ..... 137/3

5,495,875 3/1996 Benning et al. ..... 141/83

*Primary Examiner*—Steven O. Douglas

*Attorney, Agent, or Firm*—Coleman R. Reap; Salvatore P. Pace

[57] ABSTRACT

A system for filling gas cylinders with a gas mixture having a desired gas composition which includes (a) a gas conduit whose inlet end is connected to two or more gas component supply lines, each provided with a flow adjustment device, and whose outlet end is connected to a gas cylinder filling system, and which is equipped with a gas analyzer, a cumulative gas flow measuring device and, upstream of the gas analyzer, a gas mixing device; and (b) a controller which has provision for receiving signals from the flow measuring device and the gas analyzer and for sending signals to each flow adjustment device. A method of filling gas cylinders with given quantities of the gas mixtures which includes cumulatively measuring the quantity of gas flowing through the conduit, periodically analyzing the gas mixture flowing through the conduit, periodically sending cumulative gas flow information signals and gas analysis signals to the system controller, and periodically sending flow adjustment signals to the flow adjustment devices to minimize the difference between the actual gas composition and the desired gas composition.

18 Claims, 2 Drawing Sheets

DYNAMIC GAS CYLINDER FILLING PROCESS

FIELD OF THE INVENTION

This invention relates to the filling of gas storage vessels, and more particularly to the filling of gas storage vessels with gas mixtures having selected compositions by a technique which permits two or more gases to be simultaneously introduced into gas storage vessels.

BACKGROUND OF THE INVENTION

Gases that are to be shipped to various locations are generally packaged in portable vessels of various shapes and sizes which are capable of withstanding high pressures and which can be conveniently shipped. Typical of such vessels are the cylindrical containers commonly known as gas cylinders or gas bottles. These vessels are generally filled with gases by charging the gas into the vessel until the desired pressure is reached. The procedure is relatively simple and problem-free when the gas cylinder is to contain a single gas. However, when a gas container is to be filled to high pressure with a gas mixture, it is more difficult to precisely measure the quantities of all of the components of the gas mixture. Filling gas containers with mixtures is particularly problematic when the mixture is desired at high pressures because real gases do not obey the ideal gas laws under such conditions, and, in fact, each real gas behaves differently at high pressures.

High pressure containerized binary gas mixtures are generally prepared by charging one component into the container until a selected pressure is reached and then charging the second component into the container until the final pressure is reached. The selected pressure is that which corresponds to the partial pressure of the first component in the desired gas mixture. Unfortunately, because of the non-uniform nature of gases at different pressures, it is difficult or impossible to exactly produce the desired gas mixture.

The problem is further complicated when a container is to be filled with a gas mixture comprising a large concentration of one component, for example concentrations of 75 volume % or more, and small quantities of one or more other components, for example concentrations of 10 volume % or less of each minor component. In such cases the inherent inaccuracy of pressure gauges magnifies the error as the desired concentration of a component decreases. A conventional procedure for filling gas cylinders with gas mixtures comprising a minor component and a major component is to first introduce the minor component into the cylinder using a low pressure gauge, and then introduce the major component into the cylinder to the desired end pressure using a high pressure gauge. Since precision pressure gauge readings are usually accurate to within about 0.1% of full scale, the error will be small when this procedure is used. An inconvenience of this method is that different gauges are required for measuring the components of the gas mixture. Furthermore, if the minor compound is heavier than the major component, the first-filled minor component remains separated at the bottom of the gas cylinder for a prolonged period of time.

A major disadvantage of the above method of gas vessel filling is that it is necessary to charge the various components into the vessel in a serial order, i.e. one gas at a time.

Methods and systems for accurately filling vessels with gas mixtures have been considerably investigated. U.S. Pat. No. 3,653,414 discloses a system and method for charging a thermostat with a mixture of a condensable medium and a noncondensable gas. The noncondensable gas is first introduced into the sensor of the thermostat to a predetermined pressure, measured by a first pressure gauge. A quantity of the condensable medium, measured by difference in pressure using a second pressure gauge, is then introduced into the sensor.

U.S. Pat. No. 3,669,134 discloses a gas measuring method in which two gases are charged into separate chambers using separate pressure regulators that are interconnected in such a manner that the pressures of the gases are in a predetermined ratio. The apparatus and method disclosed in this patent is complex and difficult to apply, particularly when it is desired to produce mixtures of three or more gases.

U.S. Pat. Nos. 3,856,033 and 3,948,281 disclose a method of filling gas containers with mixtures of gases by continuously mixing the gases at low pressure and then pressurizing the gas mixture and subjecting the high pressure mixture to infrared analysis to determine the concentration of each component in the gas mixture. If the high pressure mixture does not have the desired composition, adjustments are made in the relative rate of flow of the components to the low pressure mixing zone to reduce the variation from the desired composition.

U.S. Pat. No. 4,219,038 discloses a gas mixing device for mixing a plurality of gases wherein each gas flows through a line that has a pressure regulator. In one embodiment of the disclosed invention the individual gases are stored in batteries of containers.

U.S. Pat. No. 4,688,946 discloses a method of mixing a liquid organic compound and a liquid propellant involving filling a metering cylinder with the liquid organic compound and then forcing the liquid organic compound, together with a predetermined volume of liquid propellant, into a mixing vessel.

U.S. Pat. No. 4,698,160 discloses apparatus for mixing two fluids for use in hemodialysis. Syringe type piston pumps are used to measure and force one or more of the components of the mixture into a mixing vessel.

U.S. Pat. No. 5,353,848 discloses procedure for accurately metering the components of a gas mixture into a gas cylinder while avoiding gas stratification, by introducing the gases into the cylinder in the order of their molecular weights using a differential pressure gauge.

U.S. Pat. No. 5,427,160 discloses a method of charging an oxidant gas and a flammable gas into a storage vessel wherein separate measuring chambers are used for each gas. The residual gas in the system lines is vented from the system.

Because of the importance of providing containerized gas mixtures in which the components of the mixtures are in precise composition, and the need to attain immediate homogeneity of vessel-contained gas mixtures, improved gas vessel filling methods are continuously sought. The present invention provides a method and system which accomplishes these objectives. This invention has the additional advantage of shortening the filling time by permitting the various gas components of a desired gas mixture to be simultaneously introduced into the gas storage vessel.

SUMMARY OF THE INVENTION

According to a broad embodiment, the invention comprises a method of delivering a measured quantity of a gas mixture having a selected composition through conduit means comprising the steps:

(a) establishing flow of a uniformly blended mixture of two or more gases past a given point in the conduit means;

(b) periodically measuring the rate of flow of gas mixture passing the given point;

(c) periodically determining the instantaneous concentration, i.e. the concentration at the time of sampling, of each gas in the gas mixture as it passes the given point;

(d) using data obtained in steps (b) and (c), periodically determining the composition of the accumulated quantity of gas mixture that has passed the given point; and (e) periodically adjusting the rate of flow through the conduit means of at least one gas of the gas mixture in a manner that will reduce differences between the determined composition of accumulated quantity of gas mixture that has passed the given point and the selected composition.

The gas mixture is preferably uniformly blended, for example, by passage through a gas mixing device before it reaches the given point in the conduit.

In a preferred aspect, step (c) of the broad embodiment is carried out using a gas analyzer. The gas analyzer can be, for example, an infrared analyzer or a mass spectrometer. In another preferred aspect, step (d) is carried out using a cumulative flow meter. In a more preferred aspect, the gas analyzer and the cumulative flow meter send signals to a control system which makes the determination of step (d). In the most preferred embodiment, in response to the determination of step (d) the control system causes a flow control means to adjust the flow of one or more gases of the gas mixture into the conduit.

The gases forming the gas mixture are generally separately introduced into the conduit through individual gas conduits. Preferably, the flow control means adjusts the flow of the gas components through the gas conduits.

In one preferred embodiment the filling method is used to fill one or more gas containers with the gas mixture by means of the conduit. In a more preferred embodiment, the method is used to simultaneously fill two or more gas containers with the gas mixture through the conduit. In another preferred embodiment, the measured gas mixture stream is used as feed to a chemical reaction.

Another embodiment of the invention is a system for delivering a measured quantity of a gas mixture having a selected composition to a downstream application. The system comprises:

(a) a gas mixture conduit having an inlet end and an outlet end and having between the inlet end and the outlet end a cumulative gas volume measuring means and a gas mixture analyzing means;

(b) a plurality of gas component supply conduits each having flow adjustment means and each being in fluid communication with the inlet end of the gas mixture conduit;

(c) a system control means for determining the composition of an accumulated quantity of gas mixture based on incremental and cumulative gas flow measurements and periodic gas mixture analyses;

(d) means for transmitting a signal from the gas analyzing device to the system control means in response to gas analysis readings;

(e) means for transmitting a signal from the cumulative gas volume measuring means to the system control means in response to gas volume measurements; and (f) means for transmitting flow adjustment signals from the system control means to one or more of the flow adjustment means in response to a determination of the composition of an accumulated quantity of gas mixture.

In a preferred aspect of this embodiment of the invention, the system comprises a gas mixing device positioned upstream of the gas mixture analyzing means.

In another preferred aspect, the gas mixture analyzing means is an infrared analyzer or a mass spectrometer. In other preferred aspects, the flow adjustment device is a variable orifice, a variable speed compressor or a fixed orifice used in combination with a valve or a variable speed liquid pump in combination with a vaporizer.

In a preferred embodiment the system includes means for filling gas containers.

DETAILED DESCRIPTION OF THE INVENTION

Figure 1:
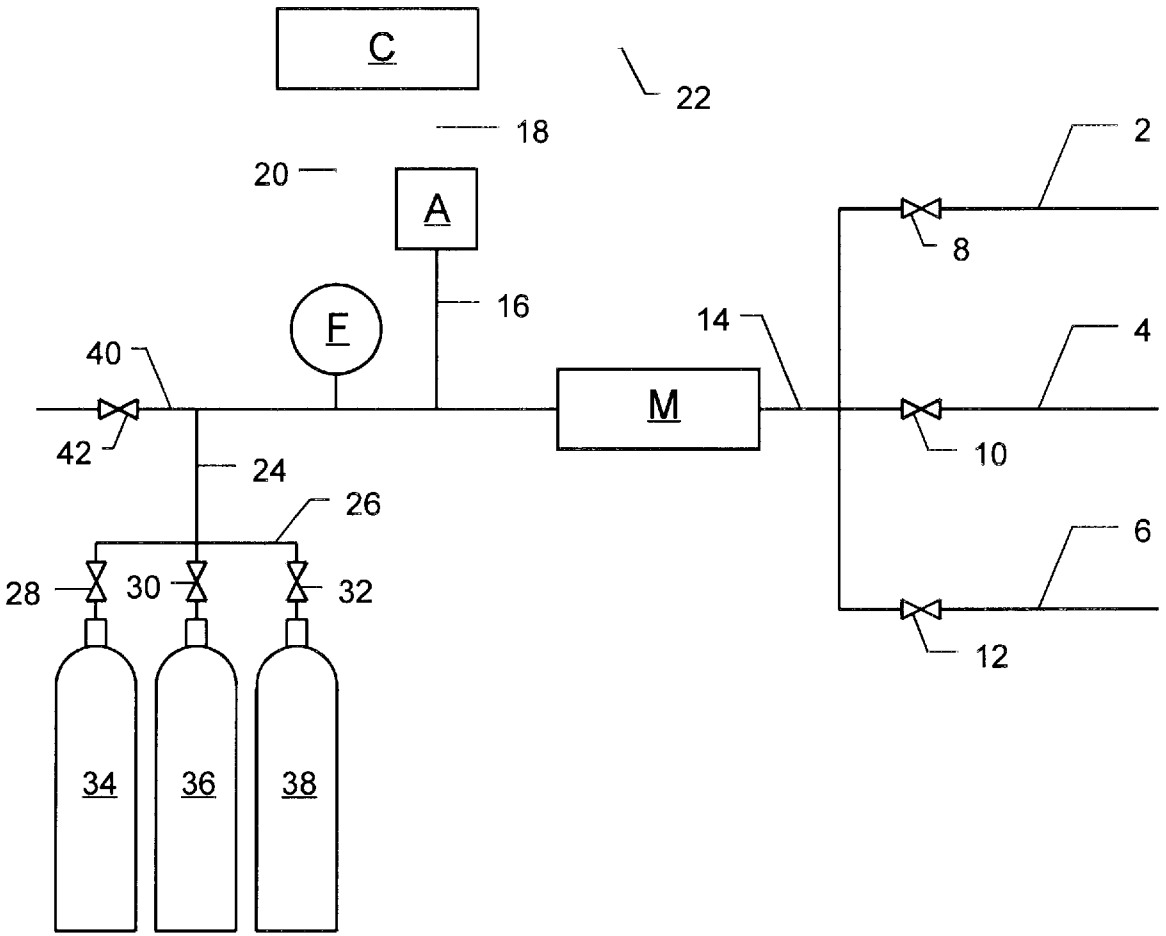
FIG. 1 illustrates a system for filling gas containers with gas mixtures in accordance with one embodiment of the invention.

The invention is useful for activities such as gas container filling operations, when it is desired to fill the containers to a selected pressure with a uniformly blended mixture of gases having a specific composition (target composition).

The apparatus of the invention comprises a gas conveying means, e.g. a conduit, a device which can accurately and continuously measure the flow of gas which passes a selected point in the gas conveying means to provide at any time an accurate cumulative measure of the gas that has passed the selected point during the activity; a gas analyzing device suitable for rapidly and accurately determining the composition of the gas currently passing the selected point at any given time during the activity; computing means capable of instantly determining the composition of the entire gas mixture that has passed the selected point in the gas conduit means during the activity (based on the gas measurements and the flow measurements); and control means for making adjustments in the flow rates of one or more gases flowing into the gas conveying means, when necessary to reduce or eliminate differences between the calculated gas composition and the target composition.

In general, the method of the invention comprises initially causing the various gas components to move into and through the gas conveying means at fixed flow rates which are intended to produce a mixture having approximately the desired composition. During the gas mixing and measuring activity the flow rate and composition of the gas mixture passing through the system remains substantially constant until it is changed, for example by varying the rate of flow of one or more individual components of the gas mixture for the purpose of adjusting its composition. The gas components entering the gas conveying means are blended to produce a flowing gas mixture of uniform composition. At selected time intervals (1) the rate of flow of gas mixture is measured as it passes a selected point in the gas conveying system and (2) the gas mixture is analyzed as it passes the selected point to determine the current concentration of each component in the flowing mixture. The flow rate measurements and gas mixture analyses results are used to determine the composition of the entire quantity of gas that has passed the selected point during the activity. If the components in the accumulated quantity of gas mixture that has passed the given point are currently passing through the gas conveying means at the desired ratios, no adjustment of flow of any component of the gas is necessary. If, however, the gas mixture has a composition that is outside the composition limits deemed to be acceptable, a signal is sent back to one or more flow control devices associated with gas lines that feed the individual gas components into the gas conveying means to cause the flow control devices to adjust the rate of gas component flow in the direction that will cause the difference between the calculated composition and the target composition to be diminished. Analyses and flow rate adjustments are made frequently throughout the duration of the filling activity, so that the composition of the gas mixture will be maintained within a narrow range.

A system typical of those useful for practice of the invention is illustrated in FIG. 1, which shows a system for mixing three components of a desired gas mixture. The system can also be used to prepare binary gas mixtures or, with minor modifications, mixtures of gases containing four or more components. The system comprises gas component feed lines 2, 4 and 6, which are respectively provided with flow control means 8, 10 and 12. The flow control means may be, for example, variable orifices, flow control valves, variable speed compressors, a fixed orifice used in combination with a valve or a variable speed liquid pump in combination with a vaporizer.

The downstream ends of feed lines 2, 4 and 6 are connected to mixed gas conduit 14, which is equipped with gas mixing device M. Mixing device M may be any gas mixing device, such as a mixing chamber typically provided with baffling to ensure uniform blending of the gases entering the mixer. Mixing chamber M is optional. In some cases the gases may become sufficiently mixed when they are combined into a single conduit, in which case a gas mixing chamber is not necessary. It is important, however, that the gas mixture entering gas analyzer A be of uniform composition to enable the analyzer to make a meaningful determination.

Gas sampling line 16 is downstream of mixer M. Line 16 is connected to gas analyzer A, which can be any gas analyzer that measures the concentration of each component of the gas mixture currently passing the selected point in line 14 ("Current Component Concentration"). Typical of suitable gas analyzers are infrared analyzers, mass spectrometers and gas chromatographs. Infrared analyzers and mass spectrometers are preferred since they are capable of rapidly analyzing gases and providing useful information. An infrared gas mixture analyzing system and its operation are described in U.S. Pat. Nos. 3,856,033 and 3,948,281, mentioned above, the disclosures of which are incorporated herein by reference.

Also associated with conduit 14 is flow measuring means F, which can be any device that continuously measures the flow of gas through a gas line and provide cumulative flow readouts. In actual installations sampling line 16 and the point in line 14 at which flow measuring device F measures the flow volume are quite close together so that the volume of line 14 between the two points is small enough to be neglected for the mass balance. Gas analyzer A and flow measuring means F provide gas analysis and total gas flow information to process controller C via data flow lines 18 and 20, respectively.

Control unit C is preferably a computer-based control device that can interpret signals received from analyzer A and flow measuring means F and compute the concentration of each gas component in the total volume of gas that has passed the selected point in line 14 ("Total Component Concentration"). Control unit C repeatedly compares the Total Component Concentration of each gas component with the specified concentration of that component in the target composition and sends an instruction to one or more of flow control devices 8, 10 and 12, when necessary, to cause the flow control devices to adjust the flow of gas component flowing through the devices.

Downstream of analyzer A and flow measuring means F line 14 is connected to an end application. In the drawing, one end application is the cylinder filling station comprising line 24, manifold 26 and valves 28, 30 and 32, which control the flow of gas into gas cylinders 34, 36 and 38, which are temporarily positioned in the station for filling. An alternate end application may be a chemical reaction plant which receives a feed gas mixture of carefully measured composition through line 40, which is provided with valve 42.

To use the system illustrated in the drawing to prepare a binary gas mixture, flow of the two gases is established in, for example, lines 2 and 4 by opening stop valves (not shown) in these lines. The flow rates of the two gases is set to provide a gas mixture of approximately the desired composition by adjusting the openings in flow control devices 8 and 10. The gas components pass into line 14, in which mixing occurs. If sufficient mixing is effected to attain a uniform blend of the gases by simple blending in line 14, then no additional mixing device is necessary. If, however, additional mixing is necessary, the gas mixture can be passed through a mechanical gas mixing device, such as mixer M. It is important that the gas mixture be uniformly blended to provide accurate and reliable gas analyses.

Analyzer A periodically samples the gas mixture flowing through line 14 via line 16 and makes Current Component Concentration determinations from each sample for each component of the gas mixture. Throughout the activity the rate of flow of gas through line 14 is cumulatively measured by flow measuring device F. Gas flow measurement means F can be positioned anywhere in line 14, since it measures the total flow of gas passing through line 14, whether or not the gas is uniformly blended, however it is preferably positioned downstream of gas analyzer A to avoid errors in flow measurement caused by the removal of gas samples from line 14 through line 16.

The Total Component Concentration for each component of the gas mixture is likewise periodically calculated from the Current Component Concentrations by dividing total flow of each gas component of the gas mixture over the completed duration of the activity by the total flow of gas mixture over the completed duration of the activity, wherein the total flow of each gas component if the gas mixture over the completed duration of the activity is determined by summing the series of products of (1) the incremental gas flow volume during a time interval equal to the period of time between samplings and the Current Component Concentration determined from a sample taken during the interval, wherein the sum of the time intervals is the completed duration of the activity. As noted above, if it is perceived that the Total Component Concentration at the time of a determination differs from the specified concentration of that component in the desired composition at the time of the determination, a signal will be sent to one or more of the flow control devices to make appropriate adjustments to reduce or eliminate the perceived differences. This procedure is repeated throughout the duration of the activity. It is desirable that the periods between samplings be of short duration since and the shorter the increments the more accurate the gas component concentration determinations.

The gas passing through line 14 can be used to fill gas storage vessels, such as the battery of cylinders illustrated in the drawing. In this application a number of cylinders can be simultaneously filled, or each cylinder can be separately filled. It is preferable to fill several cylinders simultaneously since, in that case, each cylinder of each batch will be filled to the same pressure with exactly the same gas composition. As an alternative application, the gas mixture can be sent to a downstream reactor of other end use application through line 40 and valve 42. This will ensure supply of a quantity of gas mixture of a desired composition.

It will be appreciated that it is within the scope of the present invention to utilize conventional equipment to monitor and automatically regulate the flow of gases within the system so that it can be fully automated to run continuously in an efficient manner.

The invention is further illustrated by the following example in which, unless otherwise indicated, parts, percentages and ratios are on a volume basis.

EXAMPLE

A battery of 14 gas cylinders (each having a water volume of 50 liters) was filled with an argon/carbon dioxide mixture having a target composition of 90% argon and 10% carbon dioxide. Each component is supplied with a variable speed liquid pump with a vaporizer at a pressure of approximately 250 bar. The argon stream was vaporized by an ambient temperature vaporizer directly connected to the argon pump. The carbon dioxide stream was evaporated by a heated vaporizer at a temperature of 100° F. After vaporizing, the gases were mixed with a static mixer. Immediately after mixing, the carbon dioxide content of a the cylinder filling stream was determined by an infrared analyzer. The filling stream was introduced into the cylinders at a flow rate of 25 std $m^3$/min. Concentration deviations of the observed sample stream are corrected by changing the speed of the carbon dioxide pump only. The argon pump is set at constant speed. Gas mixture samples were analyzed at one second intervals. When the carbon dioxide concentration was above the target concentration of 10% the flow rate of the carbon dioxide pump was reduced, and when the carbon dioxide concentration was less than 10% it was increased. The cylinder are filled to a pressure of 182 bar at 70 F.

Figure 2:
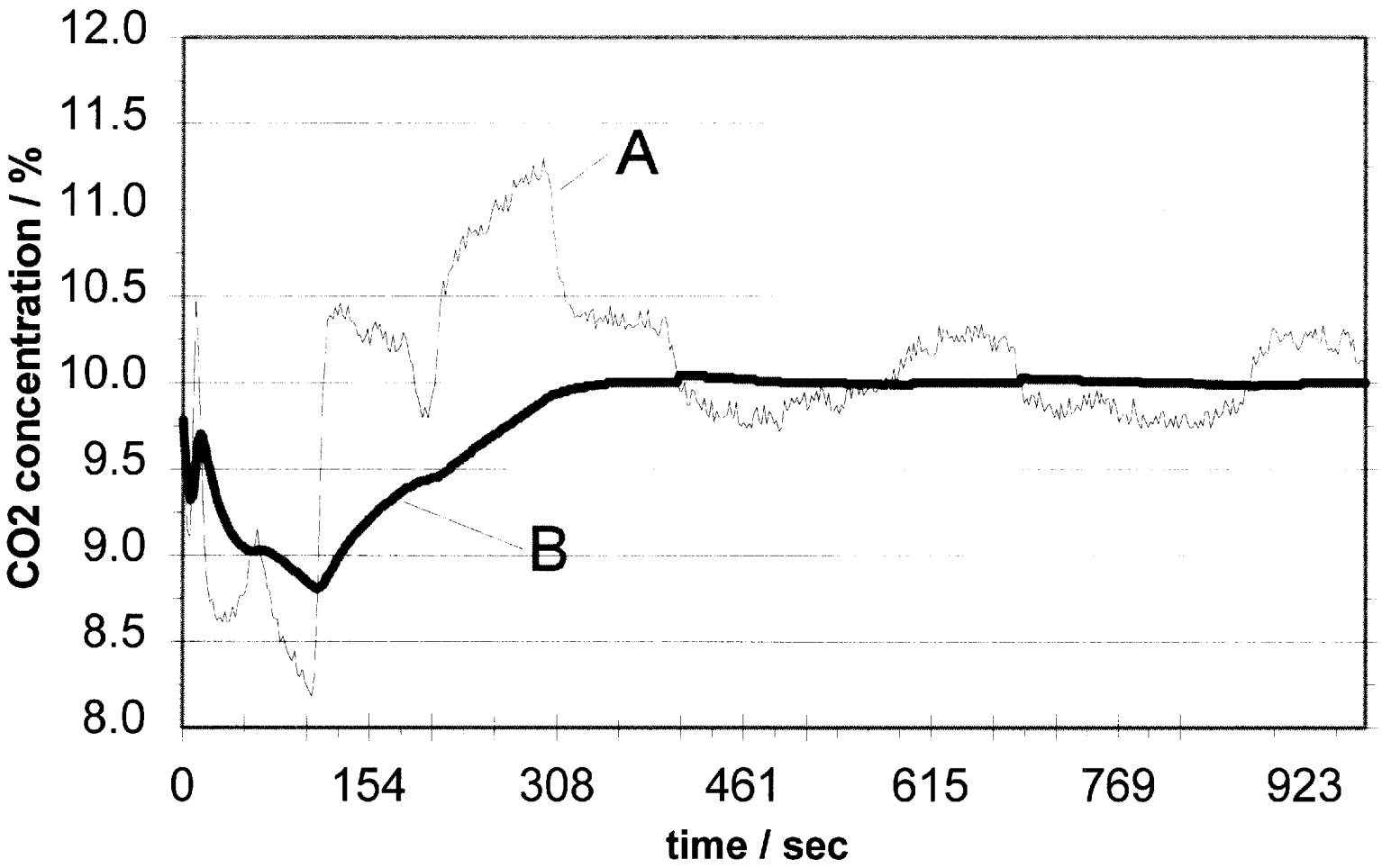
FIG. 2 is a graph of the cylinder filling history for the process presented in the example.

The results of the experiment are illustrated in FIG. 2. Curve A shows the instantaneous carbon dioxide concentration measurements vs time and curve B shows the calculated carbon dioxide concentration determinations vs. time. As can be seen, the calculated carbon dioxide concentration of the gas mixture in the cylinders at the end of the filling process is 10.00%. An independent gas chromatograph analysis of a gas sample taken from a cylinder showed that the actual carbon dioxide concentration in the gas mixture was 10.05%.

Although the invention has been described with particular reference to specific equipment arrangements and to specific experiments, these features are merely exemplary of the invention and variations are contemplated. For example, The Total Component Concentration for each component of the gas mixture can be calculated from the Current Component Concentrations by dividing (a) the integral, over the completed duration of the activity, of the product of the incremental gas flow volume during a time interval equal to the period of time between samplings and the Current Component Concentration determined from a sample taken during the interval, by (b) the total flow of gas mixture over the completed duration of the activity. The scope of the invention is limited only by the breadth of the appended claims.

What is claimed is:

1. A method of delivering a quantity of gas mixture having a selected composition through conduit means comprising the steps:

(a) establishing flow of a uniformly blended mixture of two or more gases past a given point in said conduit means;

(b) periodically measuring the rate of flow of gas mixture passing said given point;

(c) periodically determining the instantaneous concentration of each gas in said gas mixture passing said given point;

(d) periodically determining the composition of the accumulated quantity of gas mixture that has passed said point using data obtained in steps (b) and (c); and (e) periodically adjusting the rate of flow through said conduit means of at least one of said two or more gases in a manner that will reduce the difference between the determined composition and the selected composition.

2. The method of claim 1, wherein step (c) is carried out using a gas analyzer.

3. The method of claim 2, wherein step (d) is carried out using a cumulative flow meter.

4. The method of claim 3, wherein said gas analyzer and said cumulative flow meter send signals to a control system which makes the determination of step (d).

5. The method of claim 4, wherein in response to said determination of step (d) said control system causes flow control means to adjust the flow of gases into said conduit means.

6. The method of claim 5, wherein said one or more gases are introduced into said conduit means via two or more individual gas conduit means.

7. The method of claim 6, wherein said flow control means adjusts the flow of gas through one or more of said individual gas conduit means.

8. The method of claim 2, wherein said gas analyzer is an infrared analyzer or a mass spectrometer.

9. The method of claim 1, further comprising filling one or more gas containers with said gas mixture via said conduit means.

10. The method of claim 1, further comprising simultaneously filling two or more gas containers with said gas mixture via said conduit means.

11. The method of claim 1, wherein said gas mixture is used as feed to a chemical reaction.

12. The method of claim 1, wherein said gas mixture is uniformly blended by passage through gas mixing means before the gas mixture reaches said given point in said conduit means.

13. A method of delivering through conduit means a quantity of gas mixture in which each gas component of the gas mixture is present at a selected concentration, comprising the steps:

(a) establishing flow of a uniformly blended mixture of two or more gas components past a given point in said conduit means;

(b) compiling a series of flow rate measurements by periodically measuring the flow rate f of gas mixture passing said given point;

(c) compiling a series of gas component concentration values by determining the concentration c of each gas in said gas mixture passing said given point while each flow rate of said series is in effect;

(d) periodically estimating the accumulated quantity of each gas component passing said given point by cumulating the product of flow rate f. and concentration c for each gas component;

(e) periodically estimating the accumulated quantity of gas mixture passing said given point by cumulating flow rate f;

(f) periodically estimating the concentration of each gas component in the accumulated quantity of gas mixture by determining the ratio between the accumulated quantity of each gas component and the accumulated quantity of gas mixture passing said given point;

(e) periodically adjusting the rate of flow of one or more gas components through said conduit means in a manner that will reduce the difference between the estimated concentration and the selected concentration of each gas component.

14. A system for delivering a quantity of a gas mixture having a selected composition to a downstream application comprising:

(a) gas mixture conduit means having an inlet end and an outlet end and having between said inlet end and said outlet end a cumulative gas volume measuring means and a gas mixture analyzing means;

(b) a plurality of gas component supply conduit means each having flow adjustment means and each being in fluid communication with the inlet end of said gas mixture conduit means;

(c) system control means for determining the composition of an accumulated quantity of gas mixture based on cumulative gas flow measurements and periodic gas mixture analyses;

(d) means for transmitting a signal from said gas analyzing means to said system control means in response to gas analyses;

(e) means for transmitting a signal from said cumulative gas volume measuring means to said system control means in response to cumulative gas volume measurements; and (f) means for transmitting flow adjustment signals from said system control means to one or more of said flow adjustment means in response to a determination of the composition of an accumulated quantity of gas mixture.

15. The system of claim 14, further comprising gas mixing means positioned upstream of said gas mixture analyzing means.

16. The system of claim 14, wherein said downstream application is a gas container filling system.

17. The system of claim 14, wherein said gas mixture analyzing means is an infrared analyzer or a mass spectrometer.

18. The system of claim 14 wherein said flow adjustment means are variable orifices, variable speed compressors, valve-fixed orifice combinations or variable speed liquid pumps in combination with vaporizers.

* * * * *